US008213150B2

(12) United States Patent
Jurvanen et al.

(10) Patent No.: US 8,213,150 B2
(45) Date of Patent: Jul. 3, 2012

(54) DOOR LOCK

(75) Inventors: Markku Jurvanen, Niittylahti (FI); Pasi Kervinen, Niittylahti (FI); Mika Purmonen, Joensuu (FI)

(73) Assignee: Abloy Oy, Joenssu (FI)

( * ) Notice: Subject to any disclaimer, the term of this patent is extended or adjusted under 35 U.S.C. 154(b) by 0 days.

(21) Appl. No.: 12/743,365

(22) PCT Filed: Nov. 6, 2008

(86) PCT No.: PCT/FI2008/050636

§ 371 (c)(1),
(2), (4) Date: Jun. 18, 2010

(87) PCT Pub. No.: WO2009/066003

PCT Pub. Date: May 28, 2009

(65) Prior Publication Data

US 2010/0275662 A1 Nov. 4, 2010

(30) Foreign Application Priority Data

Nov. 20, 2007 (FI) ..... 20075822

(51) Int. Cl.
*H01H 47/00* (2006.01)
*H01H 47/04* (2006.01)

(52) U.S. Cl. ..... 361/154; 361/139; 361/152; 361/153

(58) Field of Classification Search ..... 361/154, 361/139, 152, 153
See application file for complete search history.

(56) References Cited

U.S. PATENT DOCUMENTS

| | | | | | |
|---|---|---|---|---|---|
| 4,422,420 | A | * | 12/1983 | Cromas et al. | 123/352 |
| 4,771,218 | A | | 9/1988 | McGee | |
| 5,018,366 | A | * | 5/1991 | Tanaka et al. | 62/228.5 |
| 5,422,780 | A | * | 6/1995 | Lignar | 361/154 |
| 5,592,921 | A | | 1/1997 | Rehbichler | |
| 5,818,679 | A | * | 10/1998 | Schustek et al. | 361/154 |
| 5,967,487 | A | * | 10/1999 | Cook et al. | 251/64 |
| 6,108,188 | A | * | 8/2000 | Denison et al. | 361/160 |
| 6,236,552 | B1 | * | 5/2001 | Hattori | 361/160 |
| 7,245,474 | B2 | * | 7/2007 | Bolz et al. | 361/154 |
| 7,499,254 | B2 | * | 3/2009 | Joens | 361/154 |
| 2003/0016102 | A1 | | 1/2003 | Hoepken | |

FOREIGN PATENT DOCUMENTS

| | | | |
|---|---|---|---|
| DE | 10 2008 014976 | A1 | 11/2008 |
| WO | 2006016822 | A | 2/2006 |

OTHER PUBLICATIONS

Van Buerden, Jason, International Search Report for PCT/FI2008/050636, Jun. 11, 2009.

* cited by examiner

*Primary Examiner* — Rexford Barnie
*Assistant Examiner* — Zeev V Kitov
(74) *Attorney, Agent, or Firm* — Chernoff, Vilhauer, McClung & Stenzel

(57) ABSTRACT

In an embodiment according to the invention, the controller for a solenoid in an electromechanical lock is arranged to generate motion power to move the solenoid plunger and holding power to hold the solenoid plunger in place so that the motion power generated consists of a higher power level and a lower power level that are alternating.

13 Claims, 2 Drawing Sheets

DOOR LOCK

This is a national stage application filed under 35 USC 371 based on International Application No. PCT/FI2008/050636 filed Nov. 6, 2008, and claims priority under 35 USC 119 of Finnish Patent Application No. FI 20075822 filed Nov. 20, 2007.

FIELD OF TECHNOLOGY

The invention relates to an electromechanical lock equipped with a solenoid. The solenoid's operation is controlled with a controller.

PRIOR ART

Electromechanical locks often use a solenoid to control deadbolting means in the lock so that the lock bolt is locked into the deadbolted position or the deadbolting means are released from the deadbolted position. A solenoid is also used to link the handle to other parts of the lock.

A typical solenoid comprises a coil fitted into a ferromagnetic body. A solenoid plunger, which is a metal rod, is located inside the coil and moved by means of a magnetic field generated around the coil. The movement of the solenoid plunger is utilised in lock mechanisms to achieve the desired action.

Figure 1:
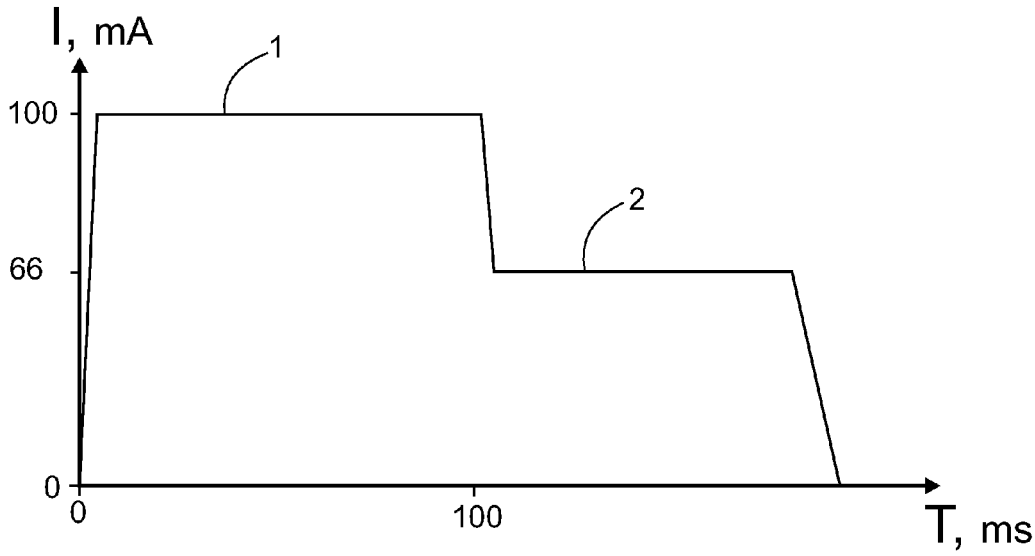

The operation of the solenoid is controlled by a controller also known as a solenoid controller. The purpose of the controller is to reduce the current consumption of the solenoid. FIG. 1 illustrates the current curve of a typical solenoid controlled by a controller. It is evident from the figure that at first, motion power 1 is routed to the solenoid to generate a sufficiently strong magnetic field to move the solenoid plunger. After a certain time, once the plunger has moved to the desired position, the current going through the solenoid is driven to holding power 2. Holding power is required to hold the solenoid plunger in the desired position as a solenoid typically employs a return spring to return the solenoid plunger to the initial position when the solenoid is unenergised. The total period of motion power and holding power is dimensioned to be sufficient for normal operation such as opening the door and/or turning the handle. The use of holding power reduces the current consumption of the solenoid. It is desirable to dimension the return spring to be as stiff as possible as confidence about the state of the unenergised solenoid is desired. More energy is required to put the solenoid plunger and the associated lock mechanism into motion compared to the energy required to hold it in place. The return spring is dimensioned with regard to the holding power in order to allow the solenoid to overcome the force of the return spring in all situations.

Electromechanical locks have relatively little space for the different components of the lock. Smaller electromechanical locks in particular require the use of smaller solenoids due to lack of space. However, the solenoid must be sufficiently large to generate the required power. Thus the problem (particularly with small solenoids) is that the solenoid must generate sufficient power while maintaining reasonable current consumption.

SHORT DESCRIPTION OF INVENTION

The objective of the invention is to reduce the disadvantages of the problem described above.

In an embodiment according to the invention, the controller 7 of a solenoid of an electromechanical lock 6 is arranged to generate motion power 3 to move the solenoid plunger and holding power 2 to hold the solenoid plunger in place so that the motion power generated is comprised of a higher power level 4 and a lower power level 5 that are alternating. Thus the motion power 3 is pulsating power that aims to overcome the friction forces working against the movement of the solenoid plunger. Pulsating motion power consumes less current than steady motion power.

LIST OF FIGURES

Figure 2:
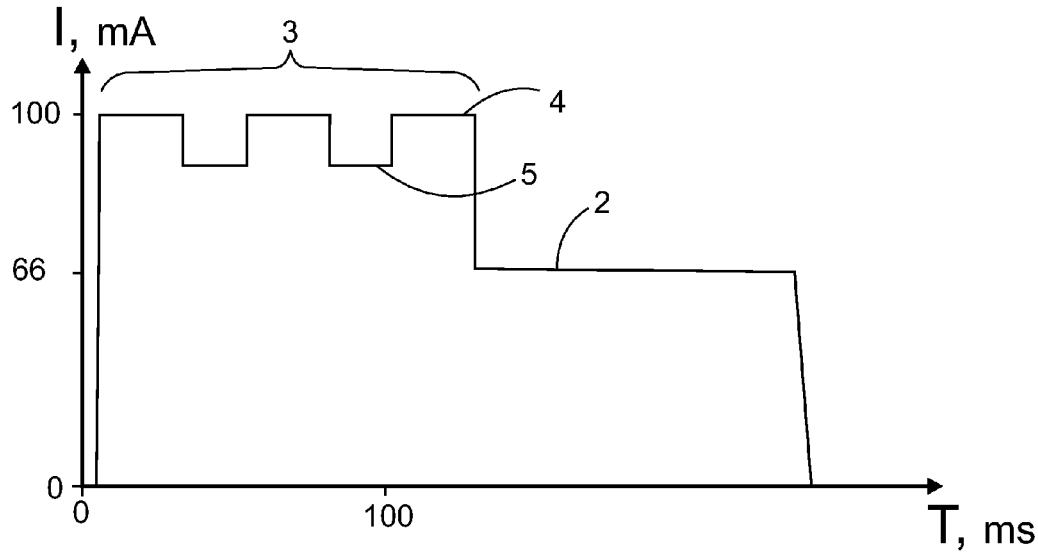
Figure 3:
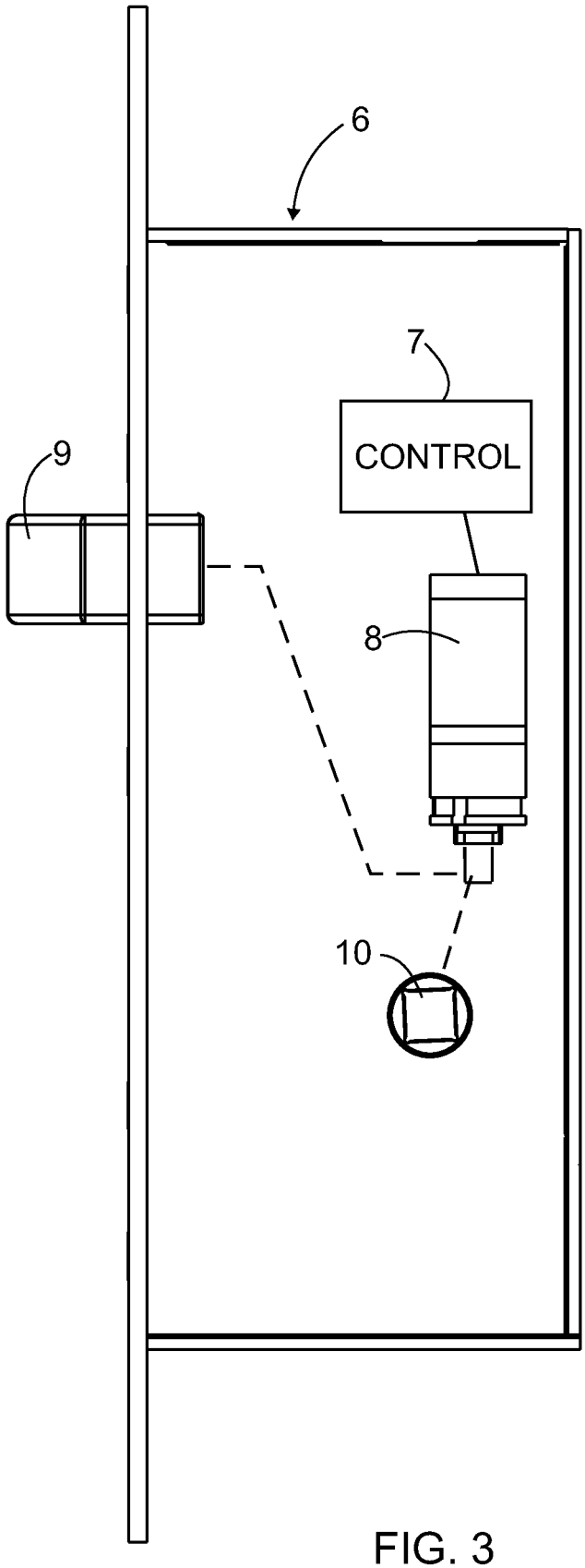

In the following, the invention is described in more detail by reference to the enclosed drawings, where FIG. 1 illustrates an example of a prior art lock solenoid controller current curve, FIG. 2 illustrates an example of a lock solenoid controller current curve according to the invention, and FIG. 3 illustrates a simplified example of an embodiment according to the invention.

DESCRIPTION OF THE INVENTION

FIG. 2 illustrates a solenoid controller current curve according to the invention, in which the motion power period 3 consists of a higher power level 4 and a lower power level 5 and the motion power period 3 is followed by a holding power period 2 in which the power level is constant. The power can be represented, for example, with the formula P=UI, in which U is voltage and I is current. When the voltage and/or current level is varied, the power level also varies. This text speaks of power levels but it is clear that the desired power level can be implemented by controlling the voltage or current. The power levels 4, 5 are alternating, such that the power varies during the motion power period 3. A pulsating force is imposed on the solenoid plunger within this power period. Pulsating power helps to overcome friction forces. The locking mechanism may be loaded (for example, door sealing strips), which makes it more difficult to put the solenoid plunger in motion. In other words, the solenoid plunger can be put in motion with less power if alternately repeating levels of motion power are used.

The period of motion power is dimensioned so that the solenoid plunger can be moved to the desired position. Approximately 130 ms is appropriate for most applications. It is preferable that the motion power period 3 starts with a higher power level. For example, three higher power levels and two lower power levels, among which the first level is a higher power level, constitute a very well-functioning solution. The duration of the higher power level 4 can be, for example, 25 to 35 ms, and the duration of the lower power level 5 can be 15 to 25 ms. In practice, periods of approximately 130 ms (or another period of motion power) can be repeated as desired, for example at intervals of 1 second or 3 seconds. This is convenient, for example, when a user is pressing the lock handle, preventing the solenoid plunger from moving. In this case, the solenoid will not warm up excessively because the duration of the higher power level is limited and it is repeated at certain intervals, while the user may have ceased pressing the handle.

FIG. 3 illustrates a simplified example of equipment according to the invention, in which the electromechanical lock 6 comprises a solenoid 8 and a solenoid controller 7. The solenoid is arranged to control either the bolt 9 or the functional linkage between the lock handle and the rest of the lock mechanism 10. The controller 7 is arranged to generate the motion power consisting of alternating power levels as described above. In handle-controlled locks, when the handle is pressed and the solenoid 8 receives a control command, the link between the handle and the rest of the mechanism is more secure when the handle is released. The solenoid operating voltage is normally 10 to 30 volts direct current. The operating voltage is modified by pulse-width modulation (PWM), for example, which creates the desired current and power level.

The solenoid controller 7 is a processor within the lock, for example. It can also be an electric circuit customised for the purpose.

Because variable-level motion power consumes less power than steady motion power at a high level, energy is saved. This also allows a smaller solenoid to more securely move the desired lock mechanisms. The load on the power supply is also smaller. Variable-level motion power allows the use of a stronger spring pulled by the solenoid. The return spring can be dimensioned in accordance with the motion power. Repeating the motion power will correct any changes in state. This makes lock operation more reliable. Also, the solenoid will not warm up unnecessarily.

As can be noted, an embodiment according to the invention can be achieved through many different solutions. It is thus evident that the invention is not limited to the examples mentioned in this text. Therefore any inventive embodiment can be implemented within the scope of the inventive idea.

The invention claimed is:

1. A controller for a solenoid of an electromechanical lock, wherein the solenoid has a solenoid plunger and generates motion power to move the solenoid plunger and holding power to hold the solenoid plunger in place, and the controller is operative in accordance with a method that comprises:

a. generating electrical power associated with motion at a first power level during a first interval and a third interval to cause the solenoid to move the solenoid plunger and generating electrical power associated with motion at a second power level during a second interval, between the first and third intervals, to cause the solenoid to move the solenoid plunger wherein one of the first and second power levels is a higher power level and the other of the first and second power levels is a non-zero lower power level, and either b1. interrupting generation of electrical power, repeating step a, and generating electrical power at a substantially constant power level to cause the solenoid to hold the plunger in place, or b2. generating electrical power at a substantially constant power level to cause the solenoid to hold the plunger in place, and wherein the controller generates electrical power at the first and second power levels by pulse-width modulation.

2. A controller according to claim 1, wherein the first power level is the higher power level and the second power level is the lower power level.

3. A controller according to claim 2, wherein step a comprises generating electrical power at a first power level during the first interval, the third interval and a fifth interval and generating electrical power at the second power level during the second interval and a fourth interval, between the third and fifth intervals.

4. A controller according to claim 1, wherein the duration of the first and third intervals is 25 to 35 ms and the duration of the second interval is 15 to 25 ms.

5. A controller according to claim 1, wherein step b1 comprises interrupting generation of electrical power for a period that is longer than the period during which electrical power is generated in step a.

6. A controller according to claim 1, wherein at least one of steps b1 and b2 comprises generating electrical power at a substantially constant power level that is lower than said lower power level.

7. An electromechanical lock comprising a controller in accordance with claim 1 and a solenoid connected to the controller to receive electrical power generated by the controller.

8. A lock according to claim 7, wherein the controller is a processor or an electric circuit.

9. A lock according to claim 7, wherein the controller supplies current to the solenoid and modifies the operating voltage at which current is supplied by pulse-width modulation.

10. A controller for a solenoid of an electromechanical lock, wherein the solenoid has a solenoid plunger and generates motion power to move the solenoid plunger and holding power to hold the solenoid plunger in place, and the controller is operative in accordance with a method that comprises:

a. generating electrical power associated with motion at a first power level during a first interval and a third interval and generating electrical power associated with motion at a second power level during a second interval, between the first and third intervals, to cause the solenoid to move the solenoid plunger wherein one of the first and second power levels is a higher power level and the other of the first and second power levels is a non-zero lower power level, and either b1. generating electrical power at a substantially constant power level lower than said lower power level to cause the solenoid to hold the plunger in place, or b2. repeating step a and then generating electrical power at a substantially constant power level lower than said lower power level to cause the solenoid to hold the plunger in place, and wherein the controller generates electrical power at the first and second power levels by pulse-width modulation.

11. An electromechanical lock comprising a controller in accordance with claim 10 and a solenoid connected to the controller to receive electrical power generated by the controller.

12. A lock according to claim 11, wherein the controller is a processor or an electric circuit.

13. A lock according to claim 11, wherein the controller supplies current to the solenoid and modifies the operating voltage at which current is supplied by pulse-width modulation.

* * * * *